US005097781A

United States Patent [19]

Meny

[11] Patent Number: 5,097,781

[45] Date of Patent: Mar. 24, 1992

[54] MAST BOOT

[76] Inventor: Robert R. Meny, 215 Hillspoint Rd., Westport, Conn. 06880

[21] Appl. No.: 647,978

[22] Filed: Jan. 30, 1991

[51] Int. Cl.[5] ..... B63B 15/00

[52] U.S. Cl. ..... 114/93; 114/361

[58] Field of Search ..... 114/89, 90, 93, 343, 114/361; 150/154, 166

[56] References Cited

U.S. PATENT DOCUMENTS

| | | | |
|---|---|---|---|
| 48,767 | 7/1865 | Gove | 114/93 |
| 132,774 | 11/1872 | Perkins et al. | 114/93 |
| 197,980 | 12/1877 | Robbins | 114/93 |
| 4,227,700 | 10/1980 | Merry | 114/93 |
| 4,945,846 | 8/1990 | Miley | 114/90 |
| 4,951,588 | 8/1990 | Hillman | 114/93 |

*Primary Examiner*—Jesûs D. Sotelo
*Assistant Examiner*—Stephen P. Avila
*Attorney, Agent, or Firm*—Epstein, Edell & Retzer

[57] ABSTRACT

A mast boot includes a flexible cover for encircling a mast mounted in a mast collar in a deck opening on a sailboat having a lower edge to be positioned around the mast collar and an upper edge to be positioned around the mast above the mast collar and opposing side edges provided with fastener strips therealong for continuously securing the side edges together to position the upper and lower edges tightly against the mast and the mast collar, respectively. Upper and lower clamps for sealing the upper and lower edges include bands to be tightened around the mast to compress the upper and lower edges, respectively, against the mast and the mast collar. Upper and lower edge seals positionable to encircle the mast include strips having fasteners thereon permitting the strips to be positioned to cover the upper and lower clamps, respectively.

20 Claims, 1 Drawing Sheet 28
46
10
12
48
30

46
50
34
60
54
36
38
58
3
40
32
42
54
3
44
56
14
4
18
22
10
26
20
24
4
12
18
70
16
62
66
62
68
64
48
52

50
72
74
74

12
72
74
74

28
14
34
46
12
34
76
48
80
82
78
16

14
20
18
12
24
18
16

MAST BOOT

BACKGROUND OF THE INVENTION

1. Field Of The Invention

The present invention pertains to mast seals and, more particularly, to a mast boot for preventing leakage around a mast positioned in an opening in the deck of a sailboat.

2. Description Of The Prior Art

Sailboats utilizing keel stepped masts typically employ a deck having an opening therein through which the mast extends for securement to the keel of the boat. A collar is usually mounted in the deck opening and includes a flange angularly disposed with the deck surface for rigging attachment via holes in the flange and an upstanding rim disposed in spaced parallel relation with the mast to permit movement of the mast within the collar. Water around the mast can leak through the deck opening between the collar rim and the mast into below deck areas. Therefore, the below deck areas must be regularly inspected for water leakage and any detected water promptly removed to avoid water damage and corrosion. Consequently, keel stepped masts are associated with increased maintenance and inconvenience, as well as potential costs for water damage repair, and such disadvantages detract from the benefits of increased strength obtained with keel stepped masts.

Various seals have been proposed for preventing leakage of water through the deck opening around keel stepped masts, and an illustrative seal is shown in U.S. Pat. No. 4,951,588 to Hillman. Conventional seals generally include specialized rigid collars for receiving the mast, in conjunction with wedges, sealing compounds or the like for insertion between the collar and the mast to provide a seal therebetween. The collars must be particularly sized to accommodate the mast, and a single collar cannot be used on the diverse mast sizes presently available on sailboats. Furthermore, the collars typically include a flange that is secured to the deck by a multitude of bolts mounted in holes drilled through the deck, and these flanges must be particularly shaped to match the applicable deck configuration. Therefore, seals relying on rigid collars generally require customized fabrication and machining, and such seals can be prohibitively expensive. Moreover, the numerous holes that must be drilled in the deck to secure the flange of the collars thereon present additional areas of potential leakage and impairs the structural integrity of the deck in sustaining forces from the mast. In decks fabricated of balsa core, the holes can be especially problematic because water penetrating the deck around the bolts can creep through the deck layers and structurally weaken the deck in the vicinity of the mast. Another deficiency associated with conventional seals is that the seals are primarily limited to installation on boats under construction because the under deck configuration on most existing sailboats is not designed to accommodate the bolts necessary for securing the collar flange to the deck. Many under deck configurations have bulkheads, wiring, hydraulic lines and the like situated near the mast, and conventional seals cannot be easily installed on such decks without complex, labor intensive disassembly and retro-fitting of existing components. Moreover, when wedges are inserted between the collar and the mast, the wedges must be secured to the collar by bolts or other securing devices, and installation of conventional seals is even further complicated. Sealing compounds inserted between the collar and the mast tend to degrade over time under flexing movement of the mast and with exposure to environmental elements, thereby compromising conventional seals. Removal of conventional seals is also extremely difficult due to the necessity of removing the wedges and/or sealing compound, as well as the collar, and the seals do not permit routine inspection of the mast/deck joint.

SUMMARY OF THE INVENTION

Accordingly, it is an object of the invention to overcome the aforementioned disadvantages of prior art mast seals.

Another object of the invention is to provide a mast boot suitable for use on diverse mast and deck configurations.

It is also an object of the invention to provide a mast boot that can be installed on an existing sailboat.

A further object of the invention is to provide a mast boot that does not require securement to the deck of a sailboat.

Yet another object of the invention is to provide a mast boot that can be easily installed by a boat owner without any specialized tools or expertise. Moreover, it is an object of the invention to provide a mast boot that can be easily removed to permit inspection of the mast/deck joint.

Still another object of the invention is to provide a mast boot that is simple and inexpensive.

In addition to the foregoing objects, the present invention possesses the advantages of being resistant to corrosion, flexible to conform to existing turning blocks or rigging on the deck, soft textured to protect hands and feet, and available in a variety of colors to compliment a boat's color scheme.

Accordingly, the mast boot of the present invention is characterized by a flexible, waterproof sheet or cover for encircling a mast and having a lower edge to be positioned around an existing mast collar that receives the mast in a deck opening on a sailboat, and an upper edge to be positioned around the mast above the mast collar. Opposing side edges joining the upper and lower edges are provided, respectively, with fastening strips to secure the side edges together continuously between the upper and lower edges when the cover is wrapped around the mast and the side edges are placed in overlapping alignment to position the upper edge tightly against the mast and the lower edge tightly against the mast collar. An upper clamp to be positioned around the mast adjacent the upper edge of the cover includes a band having opposing ends and a tightening block for selectively, relatively securing the opposing ends therein to adjustably tighten the band and compress the upper edge against the mast. A lower clamp to be positioned around the mast adjacent the lower edge of the cover includes a band having opposing ends and a tightening block for selectively, relatively securing the opposing ends in the tightening block and thereby adjustably tighten the band and compress the lower edge of the cover against the mast collar. Upper and lower edge seals to be positioned, respectively, over the upper and lower clamps include flexible, waterproof, elongated strips having opposing free ends provided with fasteners for adjustably securing the free ends together to retain the strips in a position encircling the upper and lower clamps.

Other objects and advantages of the present invention will become apparent from the following description of the preferred embodiment taken in conjunction with the accompanying drawings wherein like parts in each of the several figures are identified by the same reference characters.

DESCRIPTION OF THE PREFERRED EMBODIMENT

Figure 1:
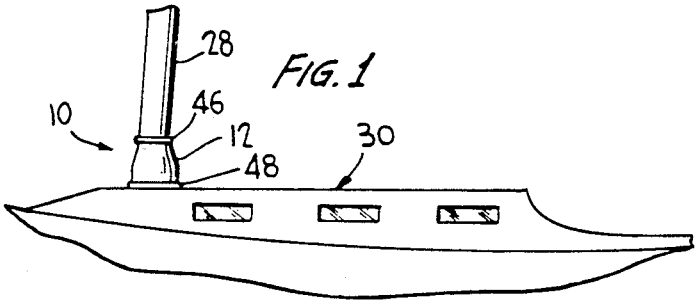
FIG. 1 is a side view of the mast boot according to the present invention mounted on a mast of a sailboat.
Figure 2:
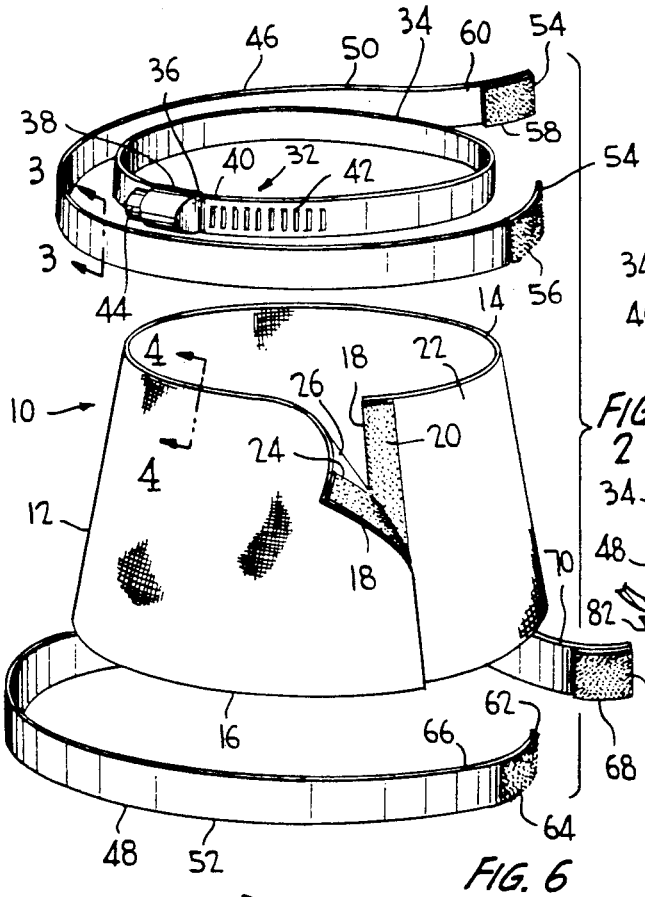
FIG. 2 is an exploded, perspective view of the mast boot of FIG. 1.
Figure 3:
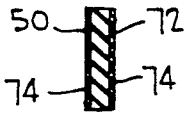
FIG. 3 is a sectional view taken along line 3—3 of FIG. 2.
Figure 4:
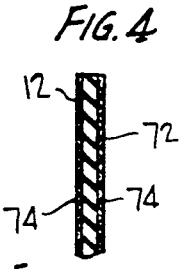
FIG. 4 is a broken sectional view taken along line 4—4 of FIG. 2.
Figure 5:
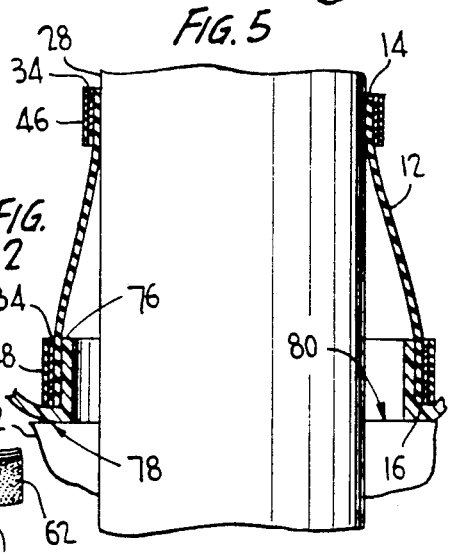
FIG. 5 is a longitudinal sectional view of the mast boot of FIG. 1.
Figure 6:
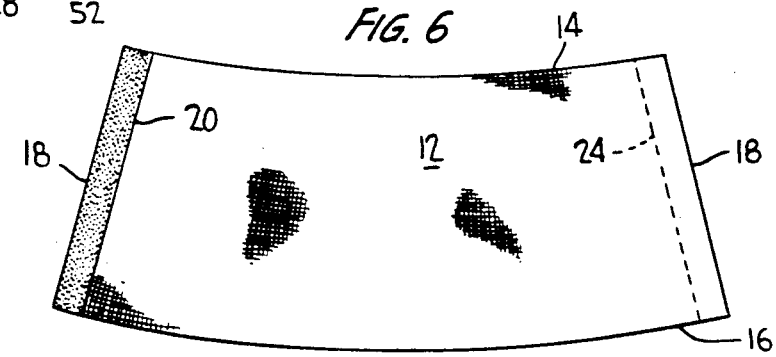
FIG. 6 is a plan view of the mast cover for the mast boot of FIG. 1.

As shown in FIGS. 1-6, the mast boot 10 of the present invention includes a mast cover or sheet 12 of substantially uniform thickness having an upper edge 14 with an inward curvature, a lower edge 16 with an outward curvature parallel to upper edge 14 and opposing, straight side edges 18 joining the upper and lower edges 14 and 16. The length of the upper edge 14 measured between the side edges 18 is less than the length of the lower edge 16, such that the side edges 18 taper linearly outwardly from the upper edge 14 to the lower edge 16. A fastening strip 20 is secured on an outer face 22 of the cover 12 adjacent one of the side edges 18 to extend continuously from the upper edge 14 to the lower edge 16, and a fastening strip 24 is secured on an inner face 26 of the cover 12 adjacent the other side edge 18 to extend continuously from the upper edge 14 to the lower edge 16. Fastening strip 20 cooperatively engages fastening strip 24 when placed in overlapping alignment therewith to secure the side edges 18 of the cover 12 together, as shown in FIG. 2, and permit the cover 12 to be positioned encircling a mast 28 of a sailboat 30, as shown in FIGS. 1 and 5.

Upper and lower clamps 32 to be positioned over the upper and lower edges 14 and 16, respectively, of the cover 12 when wrapped around a mast 28 include a band 34 of uniform width and thickness having a first end 36 secured in a tightening block 38, and a second end 40 to be inserted through the tightening block 38 for securement therein at selective positions. Slots 42 are formed in the second end 40 at spaced longitudinal locations for selectively engaging a detent in the tightening block 38 when a tightening cylinder 44 mounted in the tightening block 38 is rotated therein. As shown in FIG. 2, upper and lower edge seals 46 and 48 to be mounted, respectively, over the upper and lower clamps 32 at the upper and lower edges 14 and 16 of the cover 12 include elongated strips 50 and 52, respectively, of generally uniform width and thickness; however, the strip 52 is greater in length than the strip 50 for mounting over the relatively longer lower edge 16 of the cover 12. The strip 50 has opposing free ends 54 and a fastener 56 is provided on an outer face 58 of the strip 50 adjacent one of the free ends 54, while a fastener 58 is provided on an inner face 60 of the strip 50 adjacent the other free end 54 for cooperatively interlocking engagement with the fastener 56 to secure the free ends 54 together when the free ends are positioned in overlapping alignment. The strip 52 has opposing free ends 62, and a fastener 64 is provided on an outer face 66 of the strip 52 adjacent one of the free ends 62, while a fastener 68 is provided on an inner face 70 of the strip 52 adjacent the other free end 62 for cooperatively interlocking engagement with the fastener 64 to secure the free ends 62 together when the free ends are positioned in overlapping alignment.

As shown in FIG. 4, the mast cover 12 is preferably fabricated of a layer or sheet of flexible, neoprene rubber 72 or the like covered on all faces with a waterproof and ultra-violet resistant fabric 74. As depicted in FIG. 3, edge seal 50 is also preferably made from a layer or strip of flexible, neoprene rubber 72 or the like covered on all faces with a waterproof and ultra-violet resistant fabric 74, and the edge seal 52 is similarly constructed. The fastening strips 20 and 24 and the fasteners 56, 58, 64 and 68 are preferably made from cooperatively engaging, hook and loop type interlocking material such as Velcro®. The clamps 32 are preferably fabricated from stainless steel.

The cover 12, the clamps 32 and the edge seals 46 and 48 are sized and configured in accordance with the size of the mast receiving the mast boot. For example, for a sailboat in the 38 foot length range, the length of the upper edge 14 is approximately 18 inches; the length of the lower edge 16 is approximately 24 inches; the length of the side edges 18 is approximately 10 inches; the thickness of the neoprene rubber 72 is approximately $\frac{1}{8}$ to $\frac{1}{4}$ inch, and the fastening strips 20 and 24 are approximately 10 inches in length and 1 inch in width; the edge seal 46 is approximately 18 inches long and $1\frac{3}{4}$ inches wide; the neoprene rubber for the edge seal 46 is approximately $\frac{1}{8}$ inch thick, and the fasteners 56 and 58 are approximately $1\frac{3}{4}$ inches wide and 1 inch long; the edge seal 48 is approximately 24 inches long and $1\frac{3}{4}$ inches wide; the neoprene rubber for the edge seal 48 is approximately $\frac{1}{8}$ inch thick and the fasteners 64 and 68 are approximately $1\frac{3}{4}$ inches wide and 1 inch long.

In operation, the mast cover 12 is wrapped around a mast 28 of a sailboat 30, such mast typically having an elliptical cross-section configuration, to position the lower edge 16 over an upstanding rim 76 on an existing mast collar 78 that positions the mast 28 in an opening 80 in the deck 82 of a sailboat. The fastening strips 20 and 24 on the side edges 18 of the cover 12 are positioned in overlapping alignment to secure the cover 12 in a position wherein the lower edge 16 tightly encircles the rim 76 on the mast collar 78, and the upper edge 14 tightly encircles the mast 28 above the mast collar 78 as shown in FIG. 5. A clamp 32 is placed over the cover 12 adjacent the upper edge 14, and the end 40 of the band 34 is secured in the tightening block 38 via the appropriate slot 42 to tighten the band 34 and compress the upper edge 14 of the cover 12 tightly against the mast 28. A clamp 32 is placed over the cover 12 adjacent the lower edge 16, and the band 34 is tightened in a similar manner to compress the lower edge 16 against the rim 76 of the mast collar 78. The upper edge seal 46 is placed over the clamp 32 adjacent the upper edge 14 of the cover 12, and the fasteners 56 and 58 on the free ends 54 of the strip 50 are positioned in overlapping interlocking engagement to secure the edge seal 46 tightly around the upper clamp 32. The lower edge seal 48 is placed over the clamp 32 adjacent the lower edge 16 of the cover 12, and the fasteners 64 and 68 on the free ends 62 of the strip 52 are placed in overlapping interlocking engagement to secure the edge seal 48 tightly around the clamp 32.

The structural arrangement and configuration of parts described above produce numerous advantages in the mast boot 10 of the present invention. The cover 12, the upper and lower clamps 32 and the upper and lower edge seals 46 and 48 can be easily and quickly installed on a mast of a sailboat by a boat owner without any specialized expertise or installation tools. The cover 12 does not require any through bolting or other attachment to the deck and, therefore, is suitable for all types of deck and under deck configurations and does not detract from the structural strength of the deck around the mast. The flexibility of the cover 12 permits accommodation of a variety of mast and mast collar sizes and configurations, and the fastening strips 20 and 24 permit the cover to be adjustably secured to tightly encircle virtually any mast. Furthermore, the lower edge 16 of the cover does not interfere with any rigging or the like attached to the collar or near the mast, the mast boot 10 can be applied to any existing sailboat without the need for modification or disassembly of existing components. Moreover, the mast boot 10 can be easily and quickly removed from the mast for periodic inspection of the mast/deck joint. The upper and lower clamps 32 provide a redundant seal at the upper and lower edges 14 and 16 of the cover 12, and the upper and lower edge seals 46 and 48 protect and shield the clamps 32 and further insure against water leakage through the upper and lower edges 14 and 16. The cover 12 and the upper and lower edge seals 46 and 48 waterproof and resistant to the environmental elements encountered on sailboats, and the relative softness of the cover 12 and the edge seals 46 and 48 protect hands, feet and gear coming into contact with the mast. The cover 12 and the edge seals 46 and 48 can be made in a variety of colors to compliment a boat's color scheme. Additionally, the mast boot 10 is inexpensive and simple to manufacture, making it highly cost-effective for boat owners to put a mast boot in use and carry a spare mast boot on board.

Having described a preferred embodiment of a new and improved mast boot constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A mast boot for a mast mounted in a mast collar comprising cover means for encircling the mast, said cover means having a lower edge to be positioned around the mast collar, an upper edge to be positioned around the mast above the mast collar and opposing side edges;

means on said side edges for fastening said side edges together to secure said cover means in a position encircling the mast;

lower clamp means for compressing said lower edge against the mast collar;

upper clamp means for compressing said upper edge against the mast;

lower seal means for encircling the mast to seal said lower clamp means; and upper seal means for encircling the mast to seal said upper clamp means.

2. A mast boot as recited in claim 1 wherein said cover means includes a flexible sheet having a substantially uniform thickness.

3. A mast boot as recited in claim 2 wherein said fastening means secures said side edges together continuously between said upper and lower edges.

4. A mast boot as recited in claim 3 wherein said lower clamp means includes a band of substantially uniform width and thickness having free ends relatively adjustably securable together to selectively tighten said lower clamp means band around said lower edge.

5. A mast boot as recited in claim 4 wherein said upper clamp means includes a band of substantially uniform width and thickness having free ends relatively adjustably securable together to selectively tighten said upper clamp means band around said upper edge.

6. A mast boot as recited in claim 5 wherein said lower seal means includes a strip of substantially uniform width and thickness for encircling said lower clamp means band, said width of said lower seal means strip being greater than said width of said lower clamp means band to cover said lower clamp mean band.

7. A mast boot as recited in claim 6 wherein said upper seal means includes a strip of substantially uniform width and thickness for encircling said upper clamp means band, said width of said upper seal means strip being greater than said width of said upper clamp means band to cover said upper clamp means band.

8. A mast boot for a mast mounted in a mast collar in a deck of a sailboat comprising sheet means for wrapping around the mast, said sheet means having a lower edge to be positioned around the mast collar adjacent the deck, an upper edge to be positioned around the mast above the mast collar and opposing side edges joined to said upper and lower edges;

means on said side edges for fastening said side edges together continuously between said upper and lower edges in a selective position to secure said cover means in a position encircling the mast;

upper band means for wrapping around the mast to clamp said upper edge against the mast;

means for tightening said upper band means against said upper edge;

lower band means for wrapping around the mast collar to clamp said lower edge against the mast collar;

means for tightening said lower band means against said lower edge;

upper strip means for wrapping around the mast to continuously cover said upper band means; and lower strip means for wrapping around the mast to continuously cover said lower band means.

9. A mast boot as recited in claim 8 wherein said fastening means includes opposing strips of interlocking hook and loop fabric secured, respectively, on said side edges.

10. A mast boot as recited in claim 9 wherein said upper band means includes opposing ends selectively securable together in said upper band means tightening means to clamp said upper edge against the mast.

11. A mast boot as recited in claim 10 wherein said upper band means tightening means includes a tightening block for receiving said opposing ends of said upper band means to permit relative adjustable securement of said ends within said tightening block.

12. A mast boot as recited in claim 11 wherein said upper band means tightening means includes a plurality of slots disposed in one of said ends of said upper band means at longitudinally spaced locations and a detent in said tightening block selectively engagable with said slots.

13. A mast boot as recited in claim 12 further including a locking cylinder rotatably mounted in said tightening block for selectively engaging said detent in a selective one of said slots.

14. A mast boot as recited in claim 13 wherein said lower band means includes opposing ends selectively securable together in said lower band means tightening means to clamp said lower edge against the mast collar.

15. A mast boot as recited in claim 14 wherein said lower band means tightening means includes a tightening block for receiving said opposing ends of said lower band means to permit relative adjustable securement of said ends within said lower band mean tightening block.

16. A mast boot as recited in claim 15 wherein said lower band means tightening means includes a plurality of slots disposed in one of said ends of said lower band means at longitudinally spaced locations and a detent in said lower band means tightening block selectively engagable with said slots.

17. A mast boot as recited in claim 16 further including a locking cylinder rotatably mounted in said lower band means tightening block for selectively engaging said detent in a selective one of said slots.

18. A mast boot as recited in claim 17 wherein said upper and lower band means include bands of stainless steel.

19. A mast boot for a mast mounted in a mast collar in a deck of a sailboat comprising flexible, layered sheet means for encircling the mast having an outer face, an inner face, a curved lower edge to be positioned around the mast collar, a curved upper edge parallel to said lower edge to be positioned around the mast above the mast collar and a pair of opposing side edges tapering outwardly from said upper edge to said lower edge;

first fastener means on said outer face adjacent one of said side edges extending continuously between said upper and lower edges;

second fastener means on said inner face adjacent the other of said side edges extending continuously between said upper and lower edges for cooperatively interlockingly engaging said first fastener means when said first and second fastener means are positioned in overlapping alignment to secure said sheet means in a position wherein said upper edge tightly encircles the mast and said lower edge tightly encircles the mast collar;

upper clamp means for encircling the mast continuously adjacent said upper edge to compress said upper edge against the mast;

lower clamp means for encircling the mast continuously adjacent said lower edge to compress said lower edge against the mast collar;

flexible, layered upper strip means for encircling the mast continuously adjacent said upper clamp means to cover said upper clamp means, said upper strip means having opposing free ends;

means for adjustably securing said upper strip means opposing ends together to secure said upper strip means in a position tightly encircling said upper clamp means;

flexible, layered lower strip means for encircling the mast continuously adjacent said lower clamp means to cover said lower clamp means, said lower strip means having opposing free ends; and means for adjustably securing said lower strip means opposing ends together to secure said lower strip means in a position tightly encircling said lower clamp means.

20. A mast boot as recited in claim 19 wherein said sheet means includes a layer of neoprene rubber covered in waterproof and ultra-violet resistant fabric and said upper and lower strip means include strips of neoprene rubber covered in waterproof and ultra-violet resistant fabric.

* * * * *